US007009630B1

(12) United States Patent
Finger et al.

(10) Patent No.: US 7,009,630 B1
(45) Date of Patent: Mar. 7, 2006

(54) METHOD AND APPARATUS FOR PRINTING INK IMPRINTED INDICIA

(75) Inventors: John E. Finger, Milford, OH (US); Baron T. Youn, Cincinnati, OH (US)

(73) Assignee: General Data Company, Inc., Cincinnati, OH (US)

( * ) Notice: Subject to any disclaimer, the term of this patent is extended or adjusted under 35 U.S.C. 154(b) by 296 days.

(21) Appl. No.: 10/660,804

(22) Filed: Sep. 9, 2003

Related U.S. Application Data

(60) Provisional application No. 60/409,353, filed on Sep. 9, 2002.

(51) Int. Cl.

| | |
|---|---|
| ***B41M 7/00*** | (2006.01) |
| ***B41F 23/04*** | (2006.01) |
| ***B41L 23/20*** | (2006.01) |
| ***B41J 2/32*** | (2006.01) |

(52) U.S. Cl. ..... 347/212; 347/102

(58) Field of Classification Search ..... 347/212, 347/102; 430/401

See application file for complete search history.

(56) References Cited

U.S. PATENT DOCUMENTS

| | | | | |
|---|---|---|---|---|
| 6,350,071 | B1 * | 2/2002 | Conwell et al. | 400/118.2 |
| 6,476,840 | B1 * | 11/2002 | Taylor et al. | 347/212 |
| 6,646,666 | B1 * | 11/2003 | Matsuoka | 347/213 |
| 6,755,518 | B1 * | 6/2004 | Codos | 347/102 |
| 2002/0101491 | A1 * | 8/2002 | Ervin et al | 347/102 |
| 2005/0068397 | A1 * | 3/2005 | Yokoyama | 347/102 |

* cited by examiner

*Primary Examiner*—Huan Tran
(74) *Attorney, Agent, or Firm*—Frost Brown Todd LLC

(57) ABSTRACT

The present invention teaches apparatus and method for producing an indelible ink imprinted indicia particularly bar code labels and/or other identifying images. An ultraviolet light curable ink image is printed upon a selected substrate and passed through an ultraviolet radiation field wherein the combined infared and ultraviolet energy emitted by the UV light source, affects curing of the imprinted ink thereby producing an imprinted image having superior qualities.

36 Claims, 13 Drawing Sheets

METHOD AND APPARATUS FOR PRINTING INK IMPRINTED INDICIA

RELATED APPLICATIONS

This application claims priority U.S. Provisional Patent Application Ser. No. 60/409,353 filed on Sep. 9, 2002 and is incorporated herein by reference.

BACKGROUND OF THE INVENTION

The present invention relates to a method and apparatus for imprinting an indelible ink image upon a selected substrate. Such indelible inked images are particularly desirable for use in imprinting any informational images, such as a scanable bar code, upon selected substrates that are exposed to unusually harsh environments as in industrial applications. Although the following discussion uses scanable bar codes as an example of the particular usefulness of the present invention, it is to be understood that the method and apparatus taught herein may be used on any suitable substrate and for the imprinting of other useful indicia such a sequential numbering, operating data, warning notices, etc. where long life legibility of the imprinted material is required.

Many devices exist for reading bar codes printed on packages and other objects. Bar codes may be printed on retail merchandise for product and price identification at the point of sale, warehouse inventory control, process control, and many other applications.

The basic principle employed in bar code reading devices is the detection of contrasting reflected light. A source of illumination such as a low a powered helium neon laser, produces a beam of light which is may be moved across the bar code imprint. Dark areas (bars) absorb laser light, whereas light areas (spaces) reflect light that is detected by a scanner.

Optics are typically used to expand the laser beam into a line of laser light and to move the expanded laser beam across the area containing the bar code. Without the use of optics, the laser beam would only appear as a point of light. This process is commonly referred to as "moving-beam scanning." As the moving beam travels across the area to be scanned for a code, commonly called the scanning zone, the light and dark transition areas are detected and converted to a digital signal known as the code. A typical bar code consists of a defined number of light and dark transition areas having given ratios between the wide and narrow intervals.

Thus a scanable bar code consists of a series of solid parallel bars separated by open spaces. The bars and spaces are printed at either a full width or half width. The bars and spaces signify a bit pattern wherein wide spaces or bars are assigned a "one" while narrow spaces and bars are assigned a "zero" (or vice versa).

Prior art U.S. Pat. No. 3,728,677 employs a mirrored wheel having a polygonal periphery. Rotation of the mirrored wheel scans a laser beam across two azimuthally spaced mirrors, which deflect the beam downwardly to trace an "X" shaped pattern.

It is also known to use prisms and mirrors, or other apparatus, to turn the scanning beam direction of an optical code scanning system. For example see U.S. Pat. Nos. 3,663,800; 3,774,014; 3,800,282; 3,902,047; and 4,064,390.

U.S. Pat. No. 3,906,203 teaches scanning a bar code and measuring its interval widths by recording the time required to traverse each interval. The successive interval widths are then multiplied by a constant such as three, five, or eight. By storing and comparing the multiplied widths of successive scans, the scanner can determine whether the latest interval is about the same size as, or much smaller, or larger, than, the prior interval.

From the above description of bar codes, their formats and how they function, it is understandable that for a bar code system to function accurately it is desirable that the bar code, printed upon the object being scanned, contain clear undistorted set of dark and light parallel lines or bars. However, in many industrial applications and uses, the imprinted bar codes may be damaged by abrasion, chemicals, solvents and/or heat to the extent that the bar code or portions thereof maybe obliterated or otherwise unreadable.

Accordingly there is a need for a method and apparatus for imprinting a durable bar code that will resist the harsh environment of the industrial workplace.

SUMMARY OF THE INVENTION

In accord with the present invention a method and apparatus is taught by which a durable bar code, and/or any other printed material, may be applied to a suitable substrate material, which may then be adhesively affixed to or fastened by means of an alternative method to any product or article.

The Sony Chemical Corporation of America has developed a proprietary radiation-curable printing ink and a method of thermally transferring such ink from an ink ribbon to a selected substrate which is the subject of U.S. Pat. Nos. 6,476,840 and 5,729,272 incorporated herein by reference.

By the present invention a substrate having printed thereon a bar code, and/or any other information bearing image, using inks curable by application of UV light is subjected to a combination of IR and UV energy whereby the ink, on the printed image, is cross-linked thereby producing a durable printed image.

Using an elliptical reflector the light energy from a UV light source is convergingly directed to a focal point. However by the present invention, the substrate having an image printed thereon, using a UV curable ink, is passed through the focused UV radiation zone above the reflected light's focal point. Thus the UV curable ink image printed upon the substrate is cured by being exposed to the combination of UV and IR energy emitted from the UV light source.

DETAILED DESCRIPTION OF THE INVENTION

Figure 1:
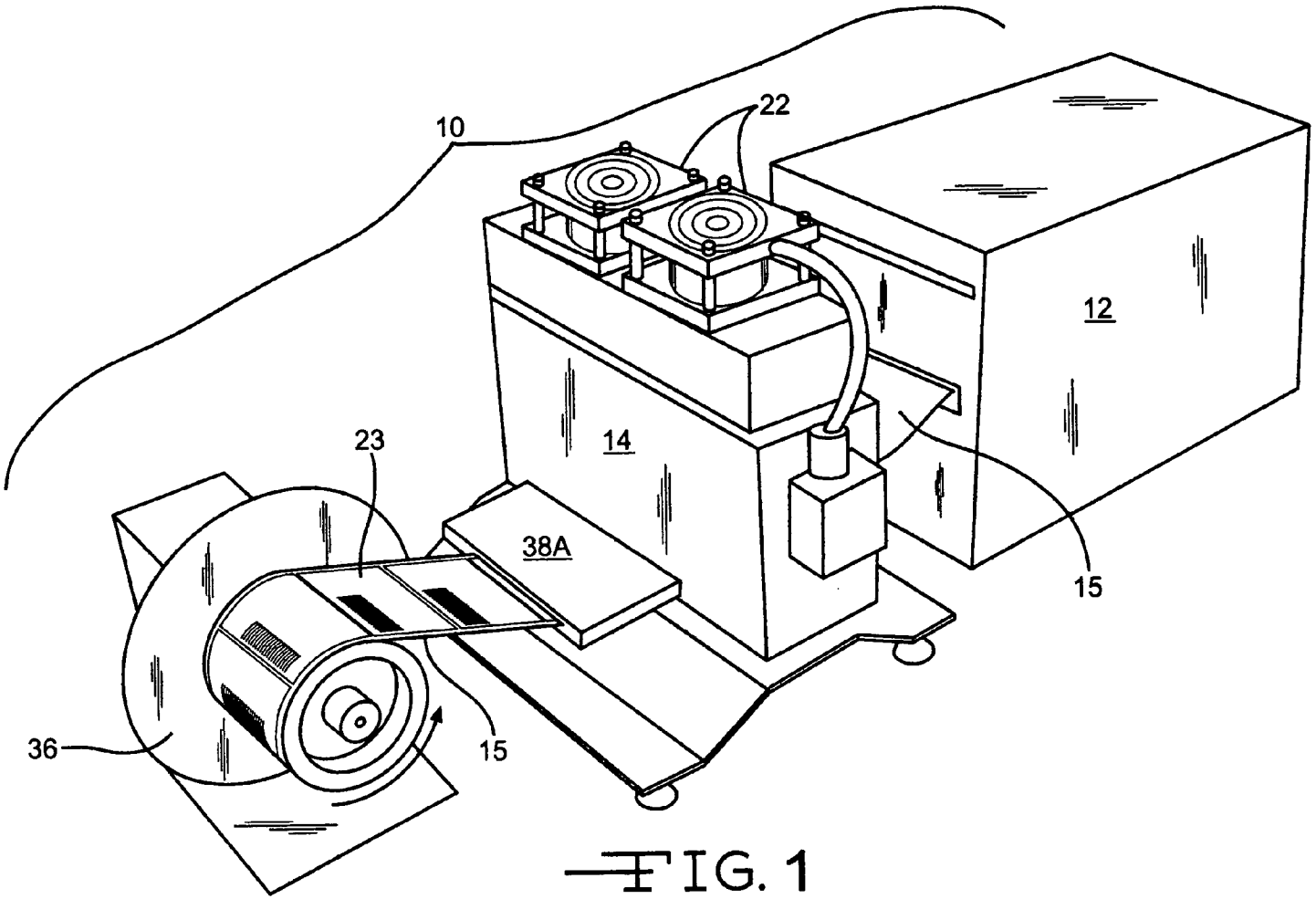
FIG. 1 presents a pictorial view of apparatus for processing a continuous roll of ink imprinted labels by the present invention.
Figure 3:
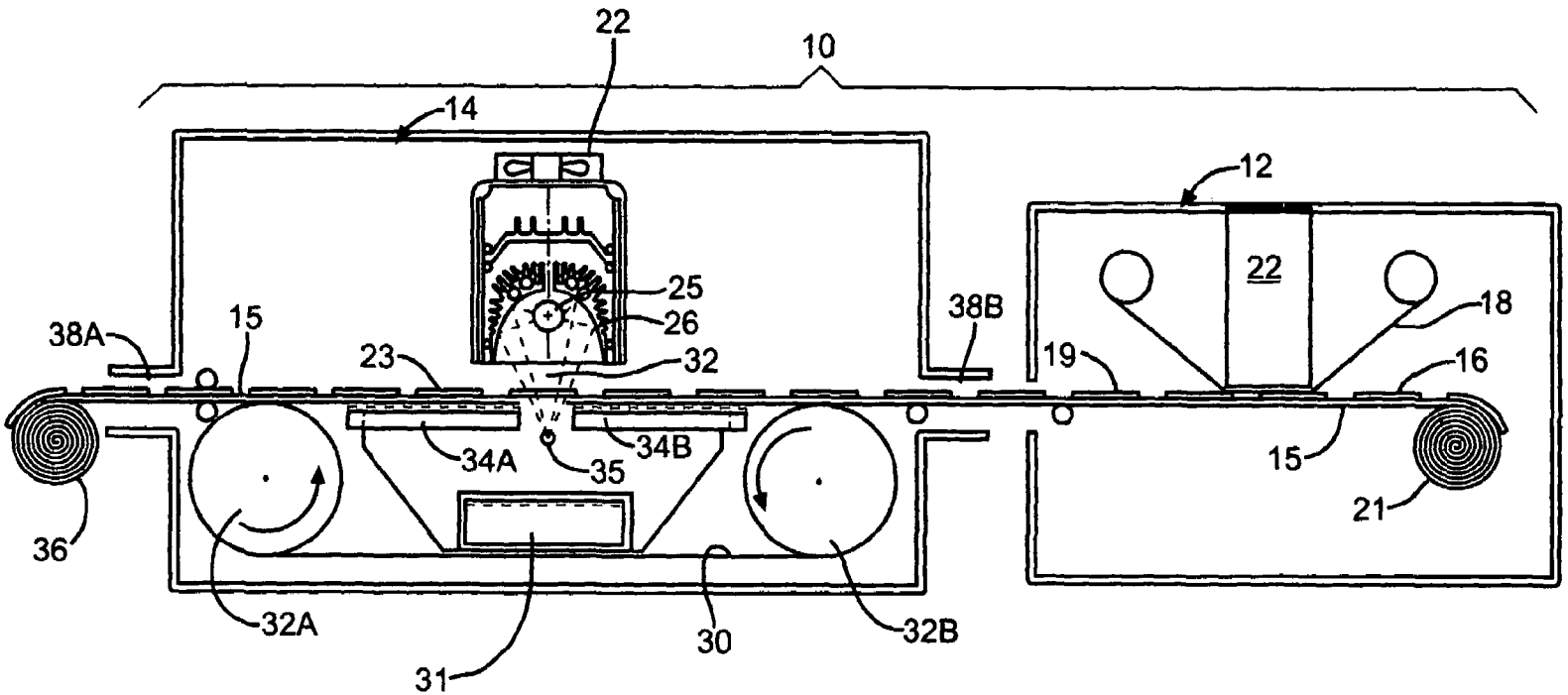
FIG. 3 presents a schematic depiction of the apparatus illustrated in FIG. 1.

Referring to FIGS. 1 and 3, the apparatus 10 for practicing the present invention comprises a thermal transfer label printing station 12 and an ink curing station 14. Within printing station 12 a continuous label carrier film 15 having blank, removable labels 16, or any other printable substrate material, removably affixed thereto, is supplied from feed roll 21. Print head 22 transfers ink from ink ribbon 18 upon labels 16 in a desired pattern as labels 16 pass thereby. Ink imprinted labels 19 then pass from printing station 12 and into curing station 14 wherein imprinted labels 19 are subjected to a focused, ultraviolet light emitted from an ultraviolet light source 25 focused by elliptical reflector 26. The combined IR and UV radiation emitted from ultraviolet light source 25 causes curing of the radiation curable thermal ink imprinted image on labels 19 as discussed in more detail below.

For a more detailed description of the ink used and the process of thermally transferring an inked image from ribbon 18 to labels 16 the reader is referred to U.S. Pat. Nos. 5,729,272 and 6,476,840 both of which are incorporated herein by reference.

As carrier film 15, having ink imprinted labels 19 thereon, pass through ink curing station 14, carrier film 15 is supported upon and carried upon endless belt 30 driven by rotating drive rollers 32A and 32B by motor means not shown. A vacuum pump 31 is provided to maintain a negative pressure across tables 34A and 34B to draw carrier film 15 down upon the tables. As carrier film 15 and ink imprinted labels 19 pass through the radiation zone 32, carrier film 15 is supported upon fixed tandem tables 34A and 34B. Tables 34A and 34B act to dimensionally fix the distance between UV light source 26 and ink imprinted labels 19 as they bass through the radiation zone 32. It is to be noted that ink imprinted labels 19 are oriented to pass above the focal point 35 of the UV light reflected from elliptical reflector 26 as illustrated in FIG. 3.

After curing of ink imprinted labels 19 within radiation zone 32, the cured labels 23 are permitted to cool prior to being wrapped upon receiving roll 36. Depending upon the exact configuration and structure of curing station 14 it may be preferred to provide covered exit and entrance conduits 38A and 38B respectively, as UV radiation shields.

Figure 2:
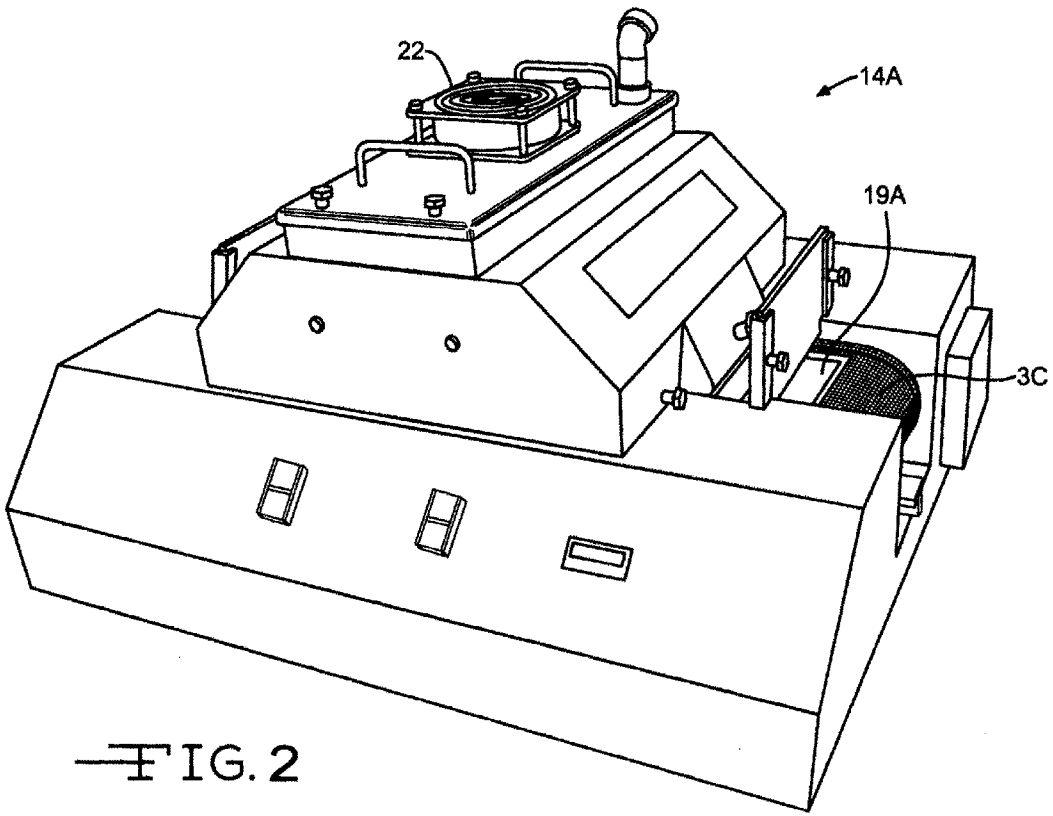
FIG. 2 presents a pictorial view of apparatus for processing individual ink imprinted cut sheet labels by the present invention
Figure 4:
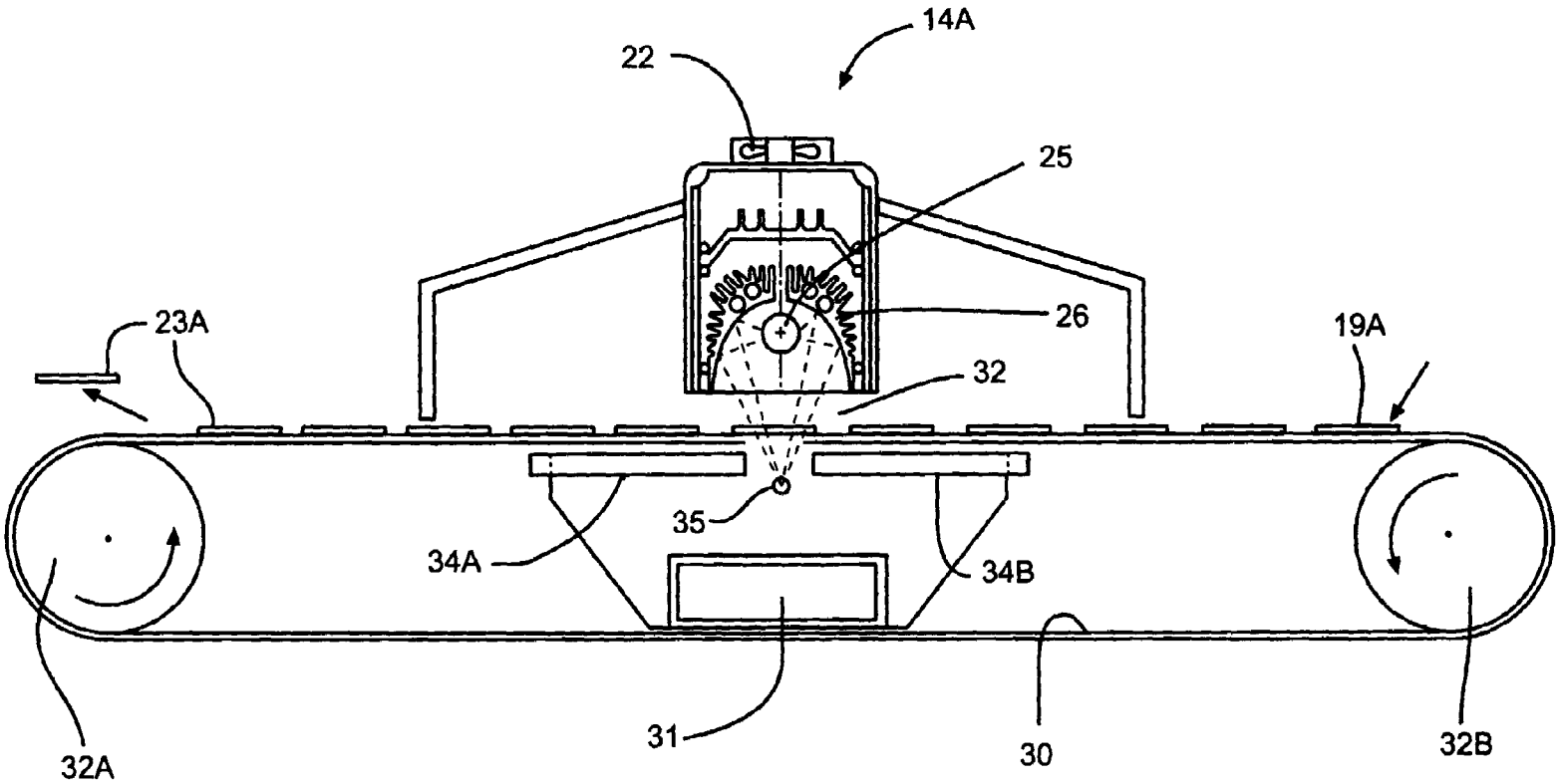
FIG. 4 presents a schematic depiction of the apparatus illustrated in FIG. 2.

Although FIGS. 1 and 3 illustrates a continuous feed label curing system wherein blank labels are feed from supply roll 21, imprinted with a UV curable ink, subjecting the imprinted UV curable ink to UV energy wherein the UV curable ink is fully cross-linked, and subsequently wound upon a receiving roll 36, FIGS. 2 and 4 presents an alternate embodiment of the process wherein preprinted, cut sheet type labels 19A may be separately feed into the ink curing station 14A manually or by any other suitable mechanical means not shown.

Ink curing station 14A generally comprises a porous web type endless belt 30 supported upon support tables 34A and 34B (similar as that illustrated in FIG. 3). Ink imprinted labels 19A are placed upon belt 30, manually or by any suitable mechanized means, whereupon labels 19A are passed through radiation zone 32 wherein the UV curable ink is fully cured. The fully cured labels 23A may then be collected by any suitable means not shown.

Figure 5:
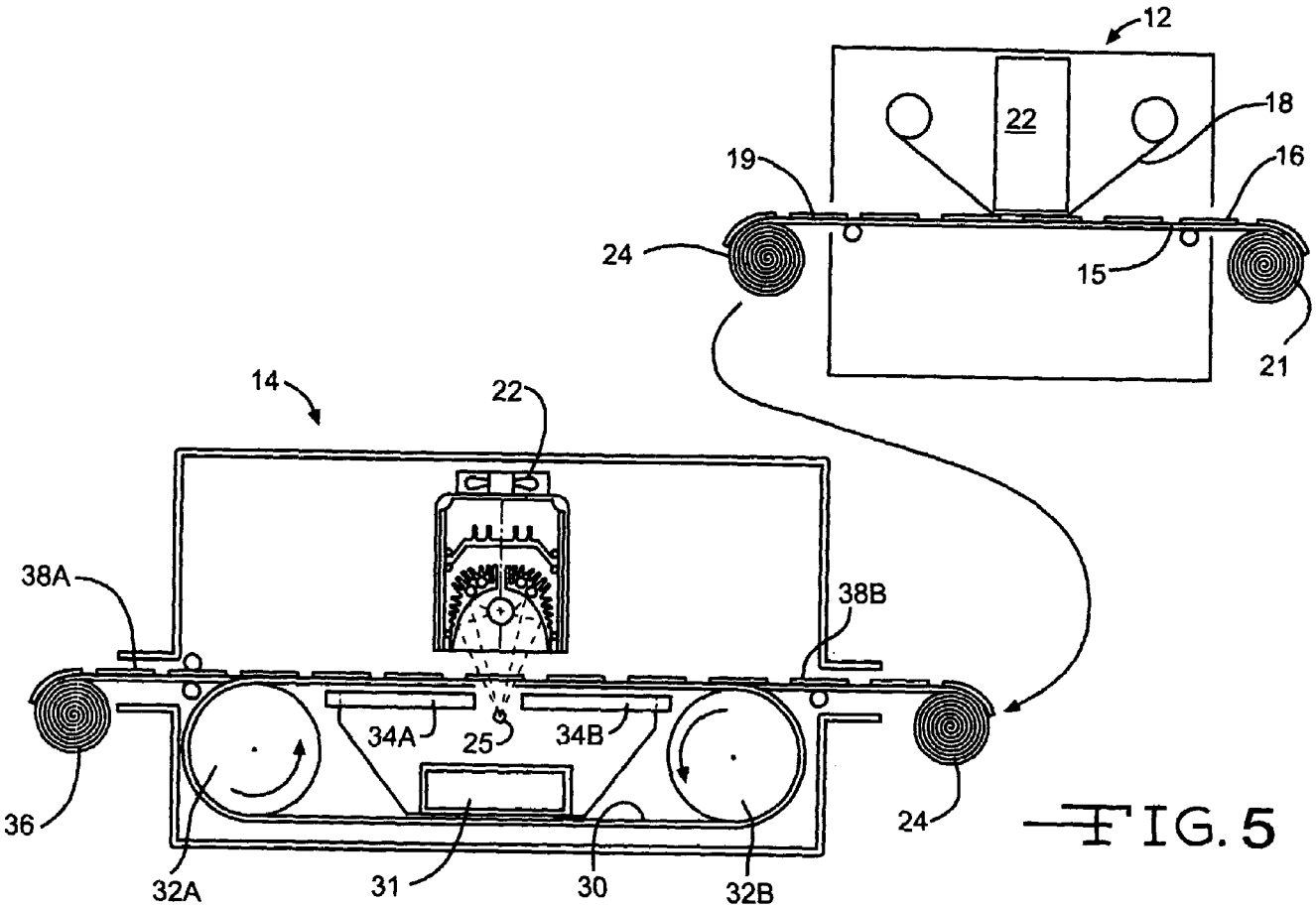
FIG. 5 presents a schematic depiction of an additional embodiment of the present invention comprising a two step process.

A further embodiment of the process illustrated in FIG. 5 may comprise a two step process wherein the ink imprinted labels, as they exit printing unit 12, are received directly upon a receiving roll 24 as opposed to being directly feed into curing station 14. The roll of ink imprinted labels 24 may then be feed into an ink curing station 14 at a later time.

Figure 5A:
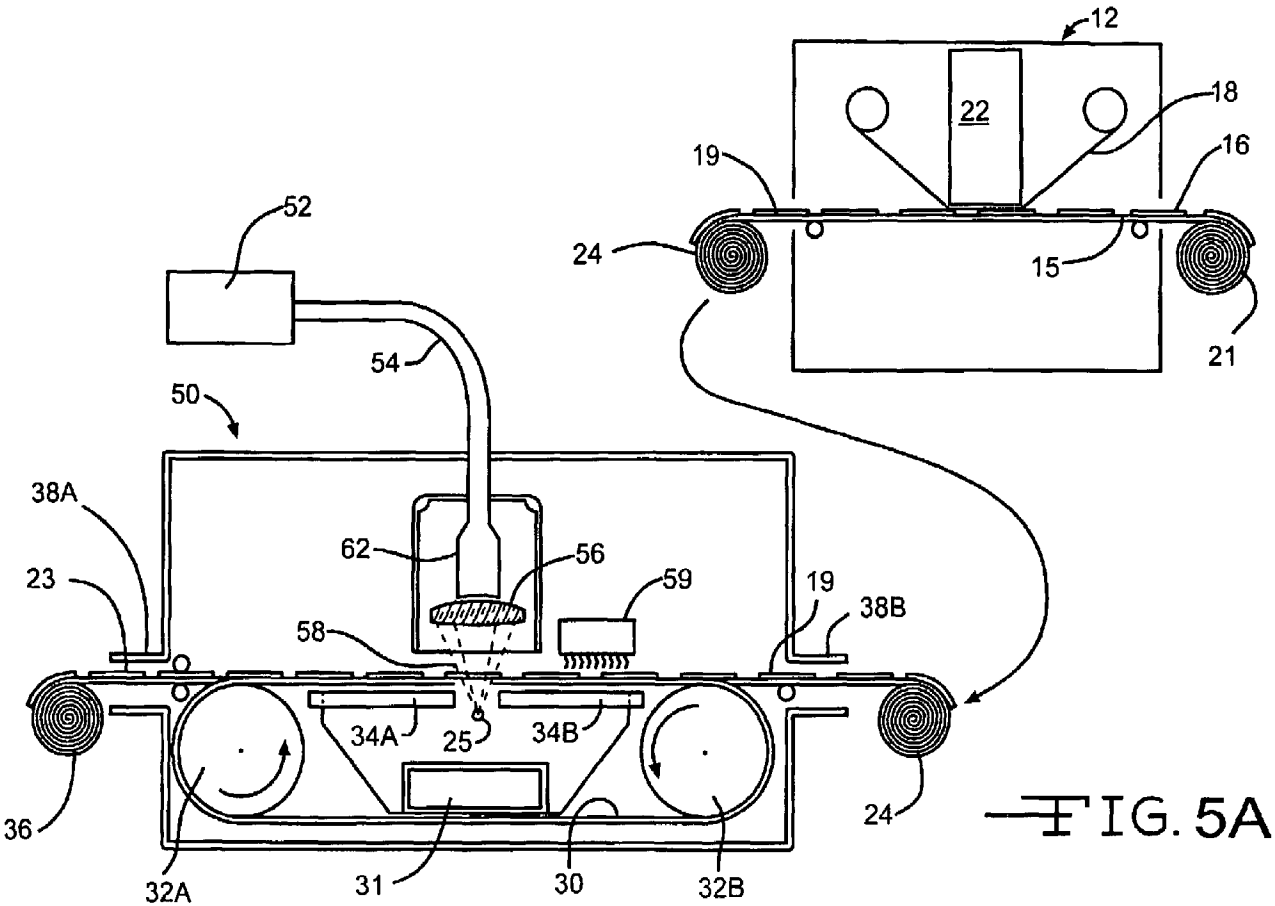
FIG. 5A generally presents a schematic depiction of the two step system as illustrated in FIG. 5 wherein the UV energy source and its associated elliptical reflector has been replaced by a remote UV energy source and a liquid filled light guide.

Illustrated in FIG. 5A is a further alternative embodiment of the ink curing station identified as element 50. In ink curing station 50 the UV light source 25 and its associated elliptical reflector 26, illustrated in FIG. 5, has been replaced by a remote UV energy source 52 having a UV energy delivery medium such as a flexible, liquid filled light guide 54. UV energy transmitted from remote source 52, through light guide 54 is received within light discharge unit 62 and thereafter passed through an appropriate focusing lens 56 whereby a focused UV radiation field 58, similar to radiation field 32 in FIG. 5, is directed to focal point 25.

Figure 5B:
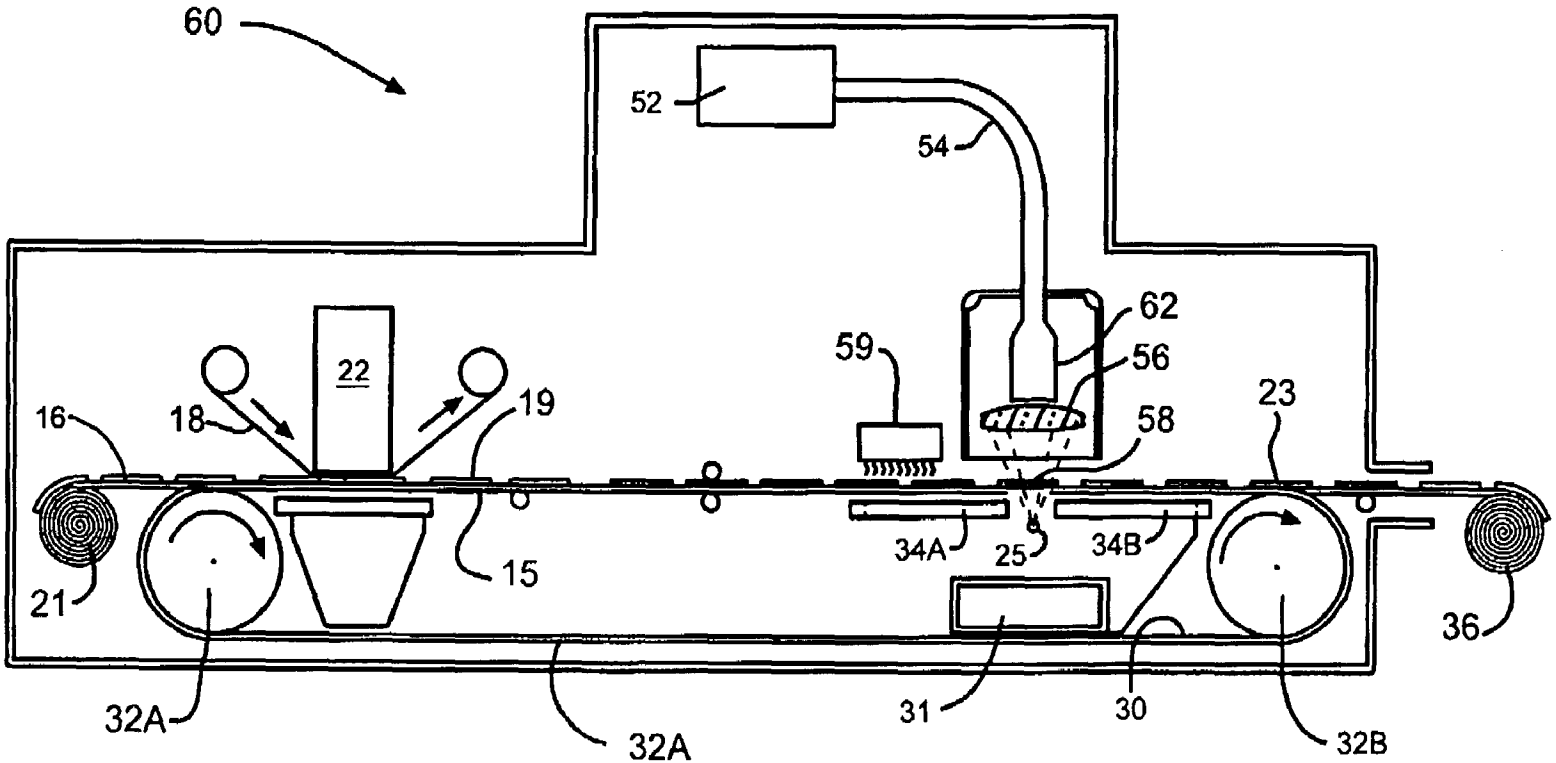
FIG. 5B schematically presents the system as illustrated in FIG. 5A wherein the thermal transfer printing apparatus and the UV curing apparatus have been combined into one printing unit.

Similarly FIG. 5B presents an additional embodiment, of the present invention, wherein the thermal printing apparatus 22 and the UV curing apparatus has been combined into a unitary printing device 60. Although the embodiment illustrated in FIG. 5B illustrates use of a remote UV energy source 52 and its associated light pipe 54, it is to be understood that the FIG. 5B embodiment may also be structured to use the elliptical reflector 26 and UV light source 25 as illustrated in FIG. 5.

However, because of the remote location of UV energy source 52 and/or of the possibility the remote UV energy source may include an IR filter, it may be necessary to provide a preheater 59 to raise the temperature of the imprinted ink above ambient temperature to assist the curing process as described further below.

Although the above embodiment employing a remote UV energy source is described as being an alternate embodiment of the FIG. 5 two step process, it is to be understood that the remote UV energy source described in FIG. 5A may also be used in place of the elliptical reflector embodiments illustrated in the other figures.

Figure 6:
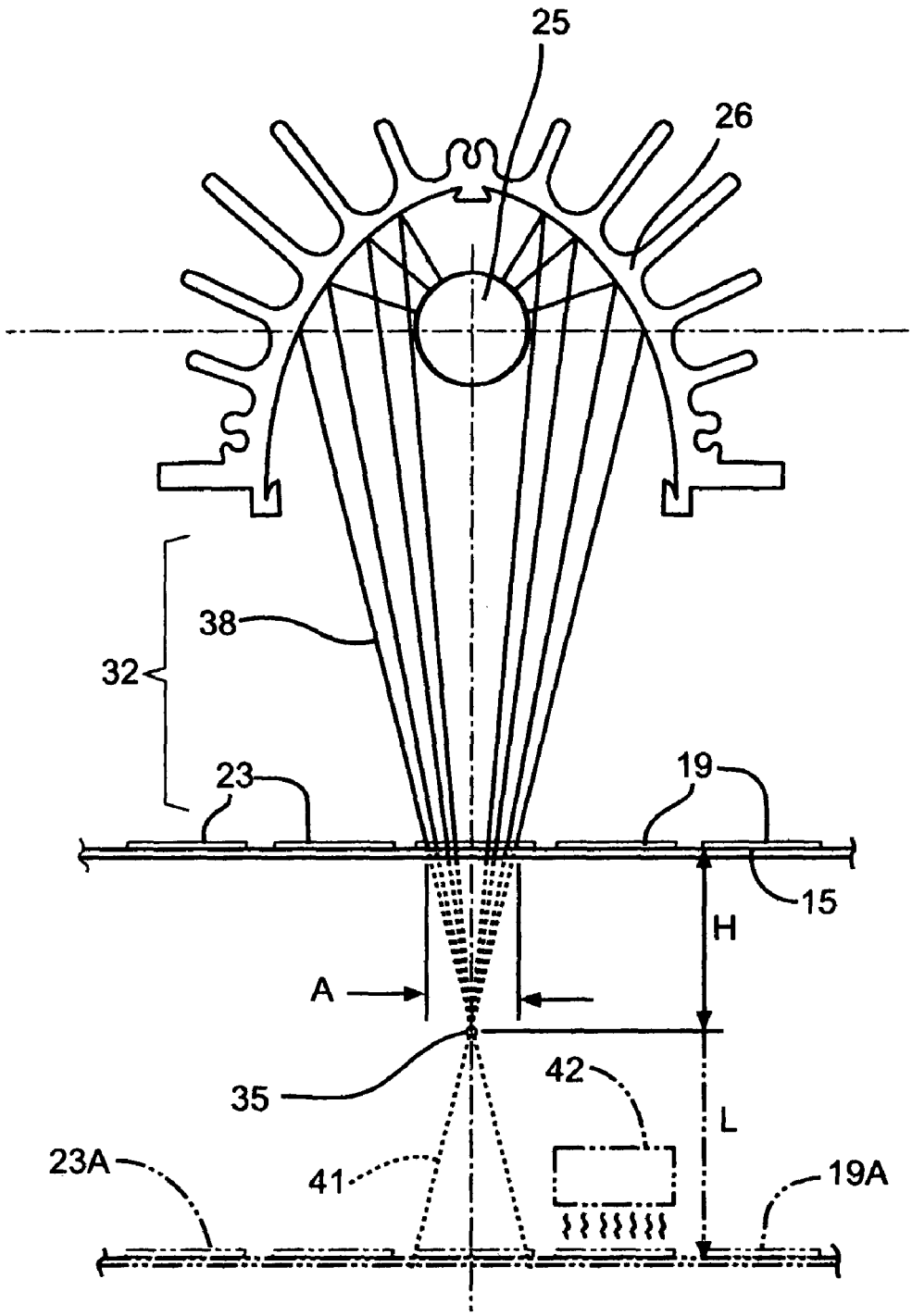
FIG. 6 presents an isolated crossectional schematic of the UV ink curing system in accord with the present invention.

Referring now to FIG. 6, UV energy source 25 is positioned within elliptical reflector 26 such that the reflected UV light rays 38 are directed to a common focal point 35. However, to affect curing of the imprinted UV curable ink it has been discovered preferable to pass ink imprinted labels 19 through the radiation field 32 above, and not through, focal point 35 as illustrated. The concentration of UV energy at focal point 35 has been found to be too intense and very likely to cause ignition of labels 19. By passing ink imprinted labels 19 through radiation field 32, above focal point 35, the amount of UV energy, per surface area, of the label 19, may be selectively chosen to labels 19.

Since the UV energy imparted to and absorbed by the ink imprinted label, is dependent upon many variables, such as, the UV light 25, surface area of the label, ink composition, ink color, line speed, substrate material parameters, etc., a quantitative value for the distance H above focal point 35 is not possible. The distance H must be determined qualitatively by empirical techniques for a given situation.

In the configuration illustrated in FIG. 6 wherein imprinted labels 19 are passed through radiation zone 32 above focal point 35 the UV curable ink imprinted upon the label substrate is dry and at ambient temperature. In order to effectively cross-link the UV curable ink imprinted upon labels 19 it is preferable to elevate the imprinted ink substantially above ambient temperature so that the UV energy may affect cross-linking of the ink composition. In the process configuration as illustrated in FIG. 6 the inherent IR energy accompanying the UV energy from UV light source 25 has been found to adequately elevate the imprinted ink temperature for this purpose. Here again quantitative values relating to the configuration illustrated in FIG. 6 are not feasible for reasons stated immediately above. However one must optimize the amount of IR and UV energy, per surface area of label 19, by experimentation considering all variables affecting the substrate and the ink printed thereon.

Alternatively one may consider passing an ink imprinted substrate 19A through the extended radiation field 41 at a distance L beyond focal point 35. However since IR energy decreases more quickly than UV energy as a function of distance from its source, optimizing the level of IR and UV energy received upon imprinted substrate 19A from UV light source 25 becomes a problem without adding means for preheating the imprinted ink on substrate 19A as it approaches radiation field 41. Such a preheating device 42 is schematically illustrated in FIG. 6. Preheater 42 may comprise a thermal convection heater, an IR heater, or any other suitable heating means. However, now one must optimize both the IR and UV energy received by substrate 19A and the energy received from preheater 42.

It is to be also considered that a preheater, such as preheater 42 my also be used to preheat substrate 19 in FIG. 6.

It is to be understood that because of the massive heat generation by the UV light source 25 within the close confines of the apparatus as schematically illustrated herein it is necessary to provide adequate circulating cooling air within the UV apparatus schematically illustrated as cooling fan 22 in FIGS. 1 through 5.

Figure 8:
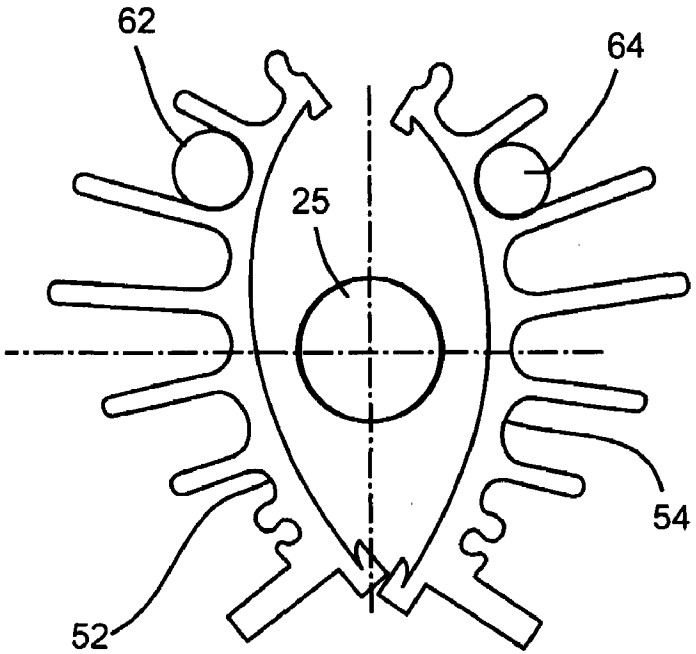
FIG. 8 presents a crossectional view of the two piece reflector illustrated in FIG. 7 wherein the two halves of the elliptical reflector are rotated to enclose the UV light source.
Figure 7:
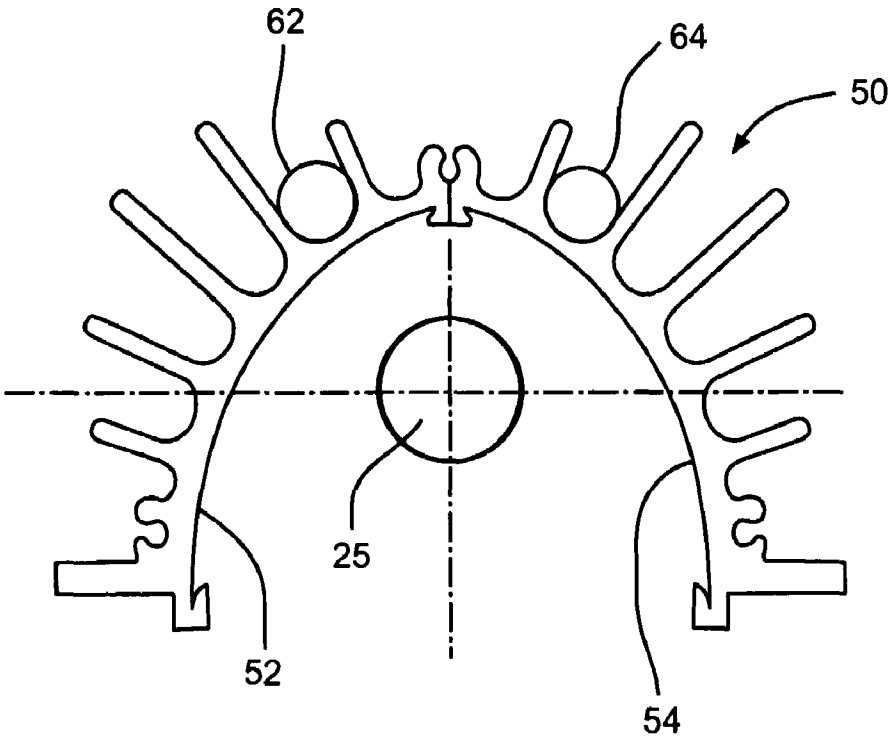
FIG. 7 presents an isolated crossectional view of an alternate embodiment of the elliptical reflector as illustrated in FIGS. 3, 4, and 5 comprising a two piece reflector that may be closed about the UV light source.

Referring now to FIGS. 7 and 8, a two piece elliptical reflector 50 is illustrated. As illustrated, elliptical reflector 50 generally comprises a left half 52 and a right half 54. Each reflector half, 52 and 54 may be pivoted about pivot points 62 and 64 respectively whereby reflector halves 52 and 54 may be rotated so as to act as shutters that enclose UV light source 25 as illustrated in FIG. 8.

Having operable shutters that may be closed about UV light source 25 is particularly useful when the operator desires to stop the machine throughput but does not desire to totally turn off UV light source 25, or if the desired line speed is otherwise sensed to diminish or stop for unanticipated causes. By closing shutters 52 and 54, about UV light 25, IR and UV radiation is prevented from reaching labels 19 and possibly causing the labels to catch fire within the machine. Similarly should the operator need to stop the machine for maintenance and/or substrate change over, the operator may reduce the power to UV light 25 to a lower level without completely turning the UV light off whereby less time will be necessary for restart.

Figure 9:
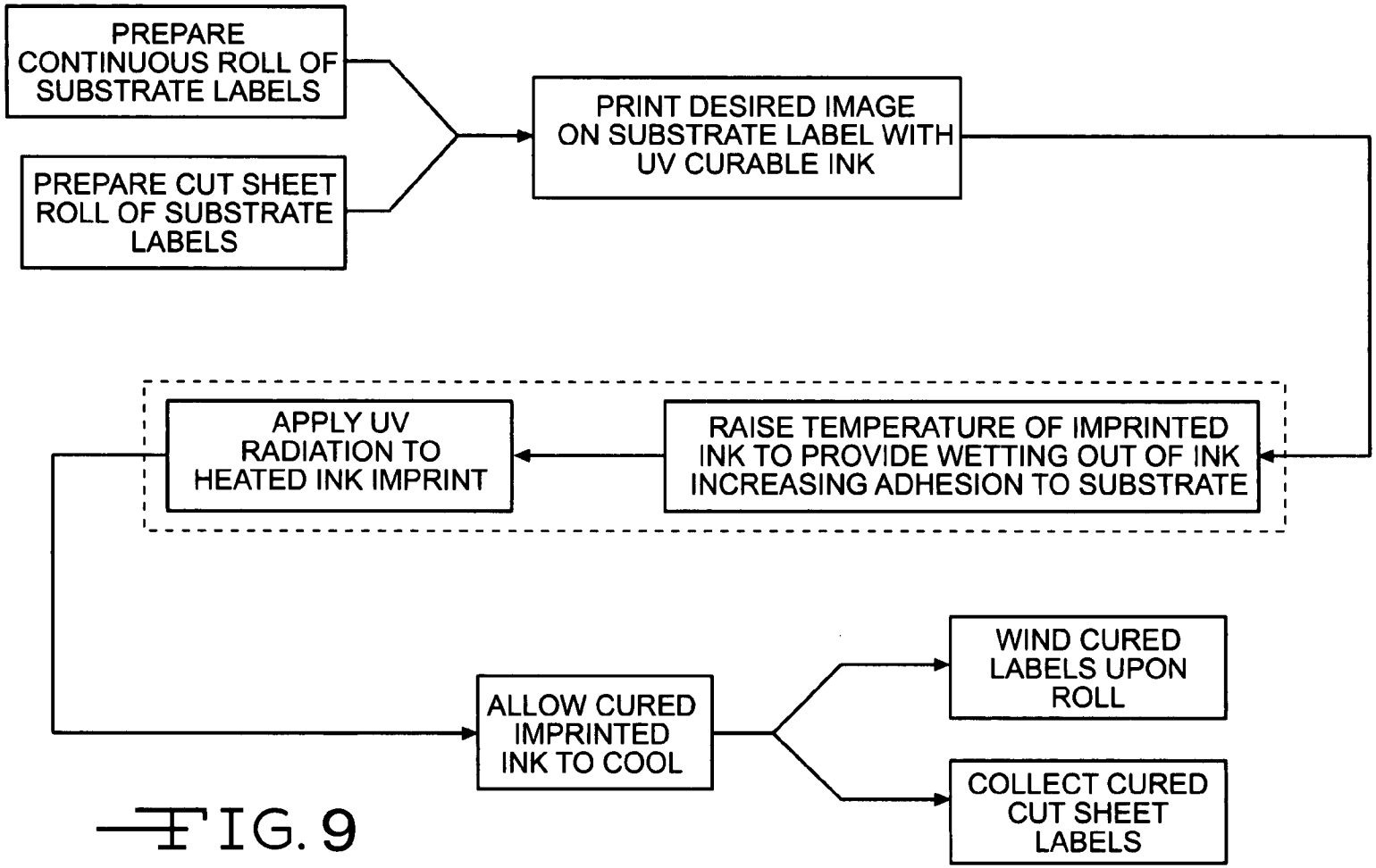
FIG. 9 presents a flow chart of the method practiced by the present invention.

FIG. 9 presents a flow chart of the method steps performed by the apparatus illustrated in FIGS. 1 and 3 in accord with the present invention. The process begins by first preparing a suitable substrate upon which the imprinted image is desired which generally, but not necessarily, comprises a continuous roll of paper labels or cut sheet paper stock. Next an UV curable ink imprinted image is printed upon the chosen substrate. It is then preferred to raise the temperature of the imprinted ink to a level above ambient temperature thereby causing the ink to flow slightly and more securely adhere to the substrate followed immediately by subjecting the softened ink to an UV radiation field whereby the softened ink is caused to cross-link into a hardened, durable substance. These two steps may be performed separately or may be preformed simultaneously. After curing of the ink is accomplished, the imprinted ink is permitted to cool and subsequently collected on a receiving roll or any other appropriate device.

Figure 10:
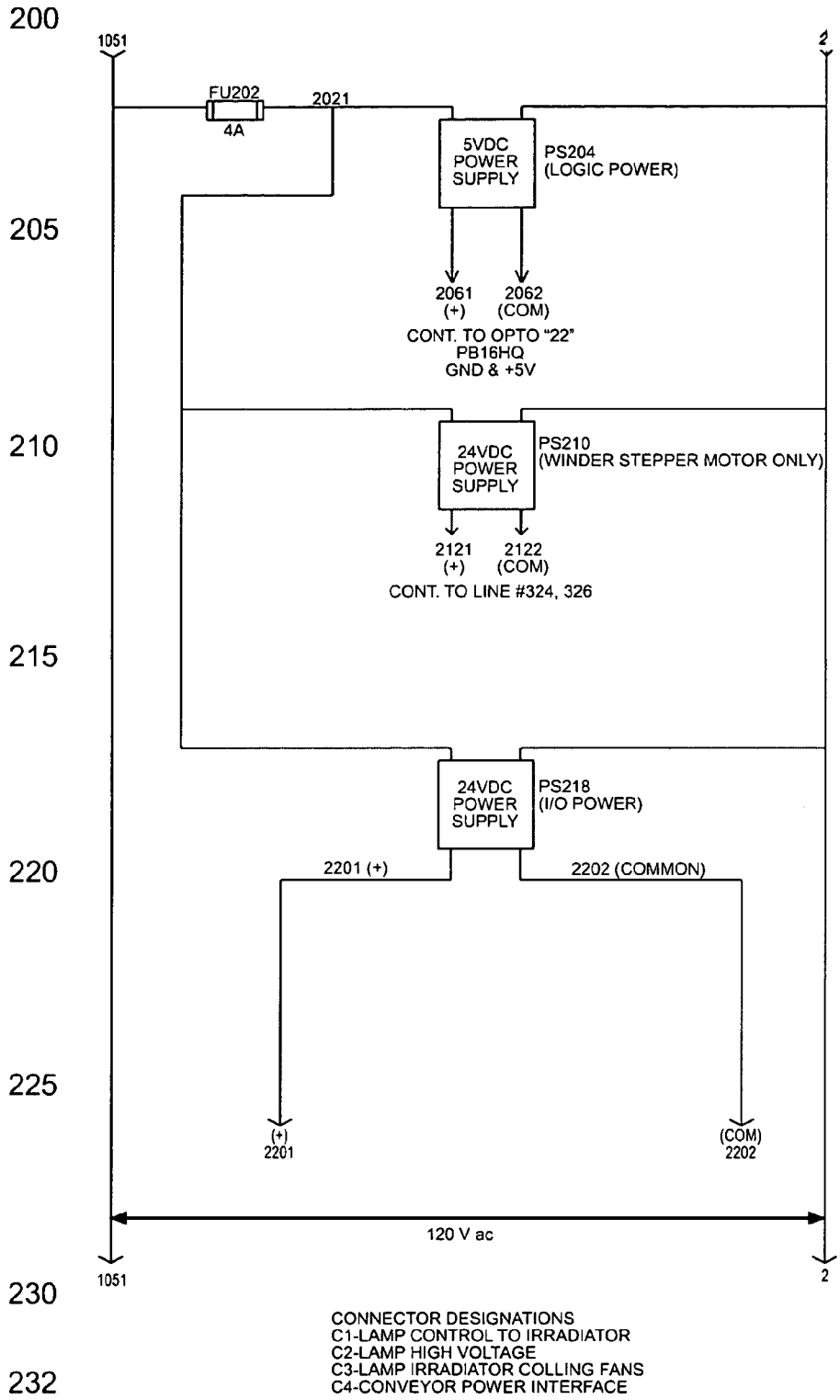
FIG. 10 presents an electrical schematic of the power supply for the apparatus illustrated in FIGS. 1 and 2.

FIG. 10 presents an electrical schematic of the 120 volt power supply for the apparatus illustrated in FIGS. 1 and 2. Since the electrical schematic of FIG. 10 is self explanatory, no further explanation is deemed necessary here.

Figure 11:
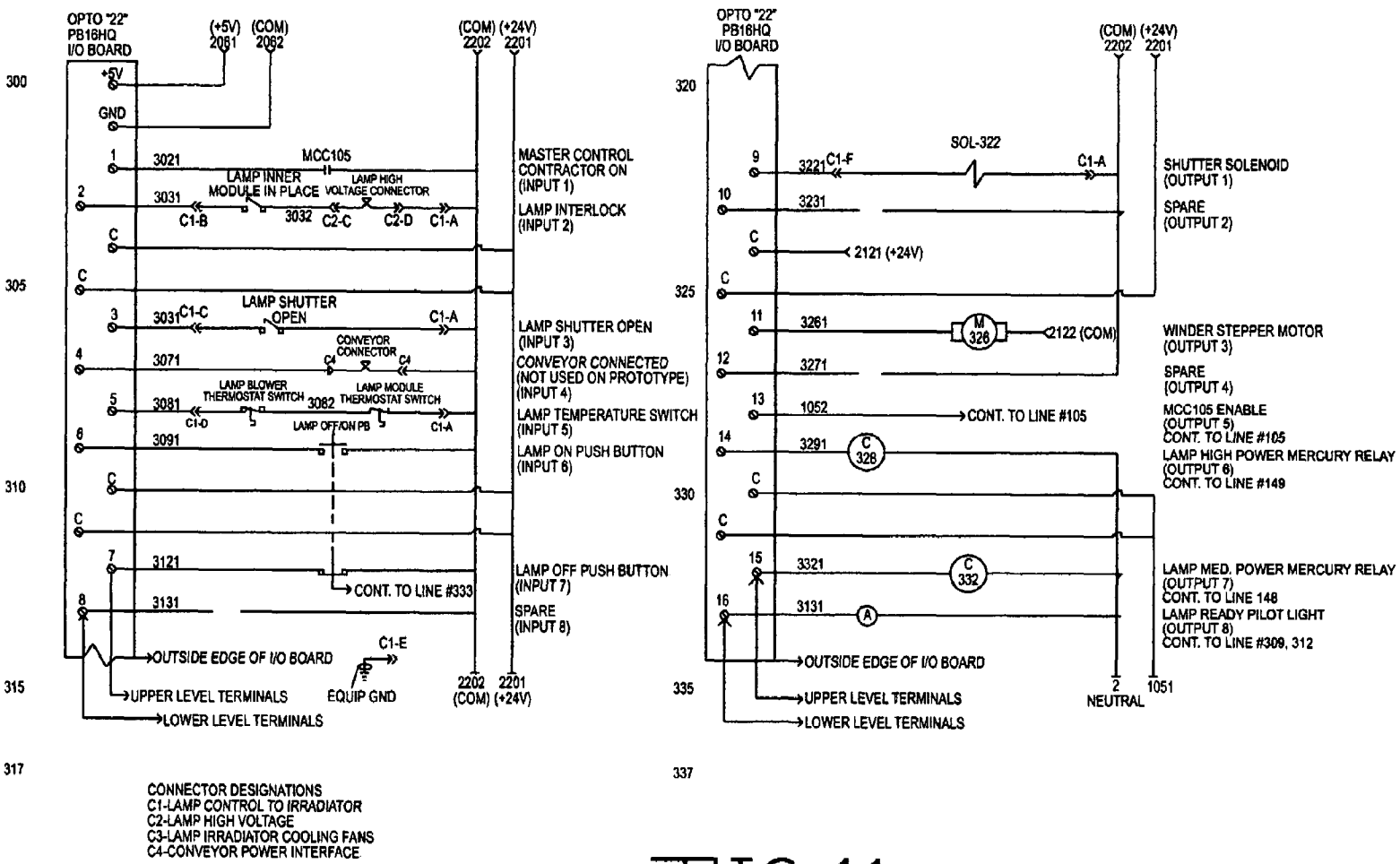
FIG. 11 presents an electrical schematic for the embodiment illustrated in FIG. 1.

FIG. 11 presents an electrical schematic for the embodiment illustrated in FIG. 1. Again as the electrical schematic in FIG. 11 is self explanatory, no further explanation is deemed necessary here.

Figure 12:
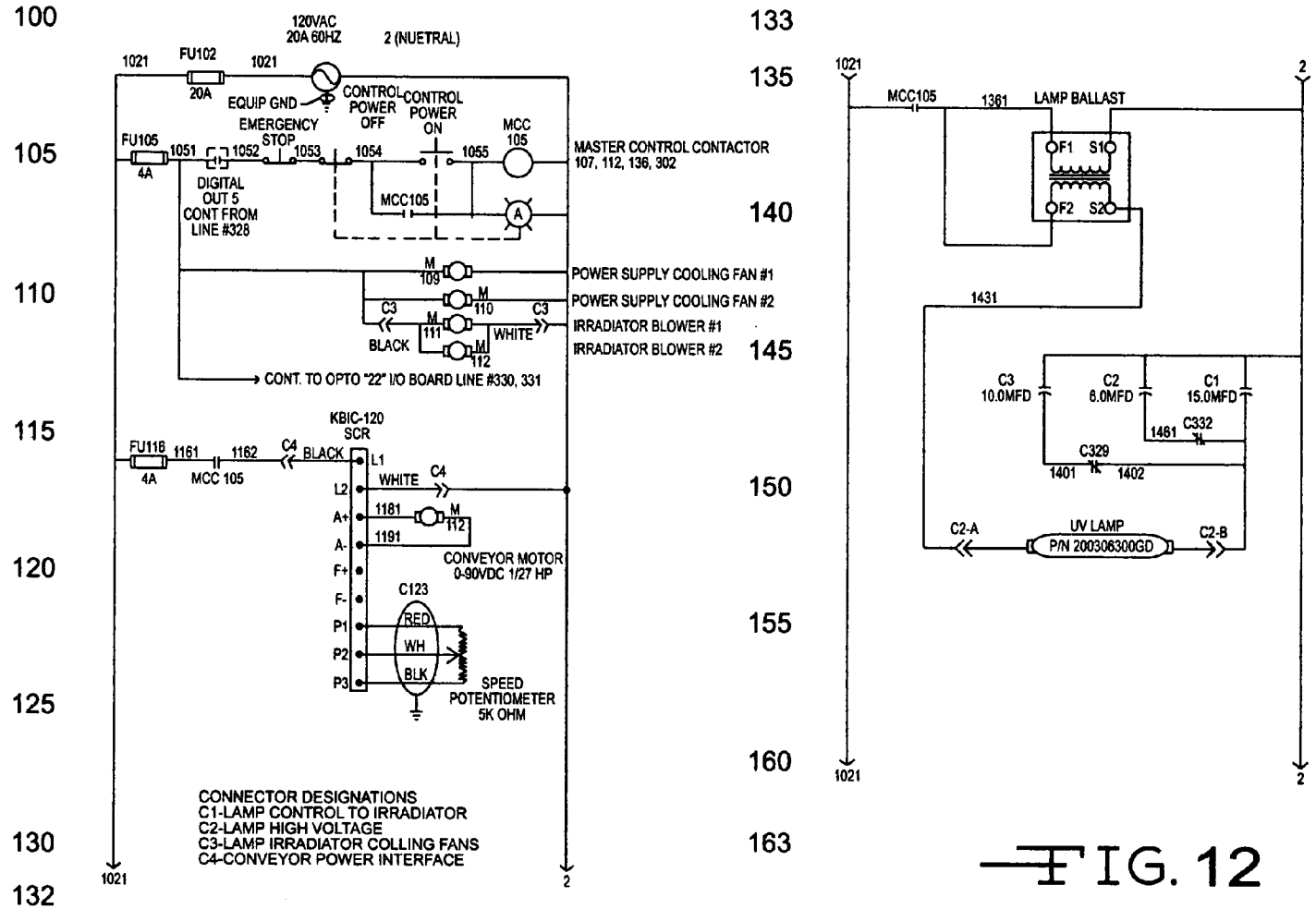
FIG. 12 presents an electrical schematic for the powering the UV energy source.

FIG. 12 presents an electrical schematic for the powering the UV energy source. Since the electrical schematic of FIG. 12 is self explanatory, no further explanation is deemed necessary here.

Although the invention has been described in detail with reference to the illustrated embodiments, variations and modifications exist within the scope and spirit of the invention as described and defined in the following claims.

We claim:

1. A method of producing indelible ink imprinted indicia upon a selected substrate comprising:

a) printing an image upon said substrate with UV curable ink, b) providing an UV energy source, c) surrounding said UV energy source with an elongated, open end elliptical reflector whereby the UV energy emitted from said UV energy source is directed to a distant focal point thereby forming converging UV radiation field, d) passing said substrate through said converging UV radiation field between said reflector and said focal point.

2. The method as claimed in claim 1 wherein said UV energy source is an elongated UV lamp.

3. The method as claimed in claim 1 including the step of preheating said imprinted UV curable ink image before passing said image through said converging UV radiation field.

4. A method of producing indelible ink imprinted indicia upon a selected substrate comprising:

a) printing an image upon said substrate with UV curable indelible ink, b) providing an UV energy source, c) surrounding said UV energy source with an open end elliptical reflector whereby UV energy emitted from said UV energy source is directed to a distant focal point thereby forming a converging UV radiation field, above said focal point and an extended, diverging UV radiation field below said focal point, d) passing said substrate through said extended, diverging UV radiation field below said focal point.

5. The method as claimed in claim 4 including the step of preheating the imprinted UV curable indelible ink image before passing said image through said extended, diverging UV radiation field.

6. A method of producing indelible ink imprinted indicia upon a selected substrate comprising:

a) printing an image upon said substrate with UV curable indelible ink, b) providing a remote UV energy source, c) providing a light pipe extending from said remote UV energy source whereby UV energy emitted from said remote UV energy source is transmitted through said light pipe and emitted from the distal end thereof, d) causing said UV energy, emitted from said light pipe distal end, to be projected through an optical lens whereby the emitted UV energy is radiated as a converging UV radiation field toward a distant focal point, e) passing said substrate through said converging UV radiation field between said optical lens and said focal point.

7. The method as claimed in claim 6 including the step of preheating said imprinted UV curable indelible ink image before passing said image through said converging, UV, radiation field.

8. A method of producing indelible ink imprinted indicia upon a selected substrate comprising:

a) printing an image upon said substrate with UV curable indelible ink, b) providing a remote UV energy source, c) providing a light pipe extending from said remote UV energy source whereby the UV energy emitted from said remote UV energy source is transmitted through said light pipe and emitted from the distal end thereof, d) causing the UV energy, emitted from said light pipe distal end, to be projected through an optical lens whereby the UV energy emitted from said light pipe distal end is radiated as a converging UV radiation field above said focal point and an extended, diverging, UV radiation field below said focal point, e) passing said substrate through said diverging UV radiation field below said focal point.

9. The method as claimed in claim 8 including the step of preheating the imprinted UV curable indelible ink image before passing said image through said extended, diverging UV radiation field.

10. Apparatus for curing UV curable ink imprinted upon a substrate comprising:

a) an open ended elliptical reflector, b) an UV radiation source positioned at the foci of said elliptical reflector, such that the UV energy emitted from said UV radiation source is convergingly directed to a focal point thereby forming a converging UV radiation field, c) means for passing said ink imprinted substrate through said converging UV radiation field between said UV radiation source and said focal point.

11. The apparatus as claimed in claim 10 including means for preheating said ink imprinted substrate before passing said ink imprinted substrate through said converging UV radiation field.

12. Apparatus for curing UV curable ink imprinted upon a substrate comprising:

a) an elliptical reflector, b) an UV radiation source positioned at the foci of said elliptical reflector, such that the UV energy emitted from said UV radiation source is directed to a distant focal point thereby forming a converging UV radiation field, above said focal point and an extended, diverging UV radiation field below said focal point, c) means for passing said ink imprinted substrate through said extended, diverging UV radiation field.

13. The apparatus as claimed in claim 12 including means for preheating said ink imprinted substrate before passing said substrate through said extended UV radiation field.

14. Apparatus for curing an UV curable ink imprinted image upon a substrate comprising:

a) an UV energy source, b) a light pipe extending from said UV energy source having a distal end whereby UV energy emitted from said UV energy source is transmitted through said light pipe to said distal end and emitted therefrom, c) an optical lens positioned such that UV energy emitted from said UV energy source will pass through said optical lens and exit therefrom as a converging UV radiation field having a distant focal point, d) means for passing said ink imprinted image through said converging UV radiation field between said optical lens and said focal point.

15. The apparatus as claimed in claim 14 wherein said means for passing said ink imprinted image through said converging UV radiation field comprises an endless belt.

16. The apparatus as claimed in claim 14 including means for preheating said ink imprinted image before said image passes through said converging UV radiation field.

17. Apparatus for curing an UV curable ink imprinted image upon a substrate comprising:

a) an UV energy source, b) a light pipe extending from said UV energy source having a distal end whereby the UV energy emitted from said UV energy source is transmitted through said light pipe to said distal end and emitted therefrom, d) an optical lens positioned such that the UV energy emitted from said light pipe will pass through said optical lens and exit therefrom forming a converging UV radiation field, above the focal point of said converging UV radiation field and an extended, diverging UV radiation field below said focal point, e) means for passing said ink imprinted image through said extended diverging UV radiation field.

18. The apparatus as claimed in claim 17 wherein said means for passing said ink imprinted image through said diverging UV radiation field comprises an endless belt.

19. The apparatus as claimed in claim 17 including means for preheating said ink imprinted image before said image passes through said diverging UV radiation field.

20. Apparatus for printing an indelible, UV curable, ink imprinted image upon a substrate comprising:

a) an enclosure, b) an endless belt for supporting said substrate thereupon, said endless belt encircling a pair of spaced apart rotatable cylinders within said enclosure, whereby said endless belt forms a first, forward moving planer surface between said cylinders and a second rearward moving belt portion, c) a planer support table, between said spaced apart cylinders, for supporting said first planer surface of said endless belt, said support table having an opening therethrough, d) an open ended housing positioned above said first planer surface of said belt and opposite said opening in said support table wherein said open end of said housing is aligned with said opening in said support table, e) an elliptical reflector positioned within said housing wherein the open end of said reflector is aligned with the open end of said housing and said opening within said support table, f) an UV energy source positioned within said reflector whereby the UV radiation field emitted, from said UV energy source, is convergingly directed through said opening within said support table to a focal point below said first planer surface of said endless belt, g) means for rotating said cylinders such that a desired linear velocity of said belt over said support table, in said forward direction, is achieved.

21. The apparatus as claimed in claim 20 including means for producing a negative pressure gradient across said support table whereby said endless belt and said substrate thereupon is held firmly upon said support table as said endless belt traverses said table thereby causing said substrate to traverse said UV radiation field at a predetermined distance from said focal point.

22. Apparatus for printing an indelible, UV curable, ink imprinted image upon a substrate comprising:

a) an enclosure, b) an endless belt for supporting said substrate thereupon, said endless belt encircling a pair of spaced apart rotatable cylinders within said enclosure, whereby said endless belt forms a first, forward moving, planer surface between said cylinders and a second rearward moving belt portion, c) a planer support table, between said spaced apart cylinders, for supporting said first planer surface of said endless belt thereon, said support table having an opening therethrough, d) an open ended housing positioned above said first planer surface of said belt and opposite said opening in said support table wherein said open end of said housing is aligned with said opening in said support table, e) an UV energy source, f) a light pipe extending from said UV energy source having its distal end within said open ended housing, whereby UV energy from said UV energy source is transmitted through said light pipe to said distal end and emitted therefrom, g) an optical lens positioned such that the emitted UV energy will pass through said optical lens and exit therefrom as a converging UV radiation field, extending through said opening in said support table, and having a focal point below said first planer surface of said endless belt, h) means for rotating said cylinders such that a desired linear velocity of said belt over said support table, in said forward direction, is achieved.

23. The apparatus as claimed in claim 22 including means for producing a negative pressure gradient across said support table whereby said endless belt and said substrate thereon is held firmly upon said support table as said endless belt traverses said table thereby causing said substrate to traverse said converging UV radiation field at a predetermined distance from said focal point.

24. The apparatus as claimed in claim 22 including means for preheating said ink imprinted image before said image passes through said converging UV radiation field.

25. The apparatus as claimed in claim 10 wherein said elliptical reflector comprises two halves, each half rotatable about a pivot point whereby said open end of said reflector may be closed thereby terminating said converging UV radiation field.

26. A printing machine for printing an indelible image upon a paper substrate comprising:

a) an enclosure, b) an endless belt for supporting said substrate thereupon, said endless belt encircling a pair of spaced apart rotatable cylinders within said enclosure, whereby said endless belt forms a first, forward moving planer surface between said cylinders and a second rearward moving belt portion, c) means for rotating said cylinders such that a desired linear velocity of said belt over said support table, in said forward direction, is achieved, d) a planer support table, between said spaced apart cylinders, for supporting said first planer surface of said endless belt, said support table having an opening therethrough, e) means for creating a converging UV radiation field above said opening in said support table whereby said converging UV radiation field is projected through said opening in said support table converging at a focal point below said endless belt, f) means for placing said paper substrate upon said moving belt, whereby said paper substrate is transported, upon said belt, toward said converging UV radiation field, h) means, within said enclosure, for imprinting an UV curable, ink imprinted image upon said paper substrate as it moves upon said moving belt prior to said paper substrate passing through said converging radiation field, h) means for removing said paper substrate after it has passed through said converging radiation field.

27. The printing machine as claimed in claim 26 wherein said means for creating said converging UV radiation field is a focused elliptical reflector.

28. The printing machine as claimed in claim 26 wherein said means for creating said converging UV radiation field comprises:

a) an UV energy source, b) a light pipe extending from said UV energy source having a distal end whereby the UV energy emitted from said UV energy source is transmitted through said light pipe to said distal end and emitted therefrom, d) an optical lens positioned such that the UV energy emitted from said light pipe will pass through said optical lens and exit therefrom as a converging UV radiation field.

29. The printing machine as claimed in claim 26 including means for preheating said ink imprinted image prior to said ink imprinted image passing through said converging radiation field.

30. The printing machine as claimed in claim 26 including means for creating a negative pressure, from top to bottom, across said support table whereby said endless belt and said paper substrate drawn downward upon the top surface of said support table.

31. The method as claimed in claim 6 wherein step c includes providing a liquid filled light pipe.

32. The method as claimed in claim 8 wherein step c includes providing a liquid filled light pipe.

33. The apparatus as claimed in claim 14 wherein said light pipe is a liquid filled light pipe.

34. The apparatus as claimed in claim 17 wherein said light pipe is a liquid filled light pipe.

35. The apparatus as claimed in claim 22 wherein said light pipe is a liquid filled light pipe.

36. The printing machine as claimed in claim 28 wherein said light pipe is a liquid filled light pipe.

* * * * *